United States Patent [19]

Lee

[11] Patent Number: 4,964,600

[45] Date of Patent: Oct. 23, 1990

[54] INSULATED CUP HOLDER WITH FLEXIBLE BASE MEMBER

[76] Inventor: San F. Lee, 3922 W. Osborne, Tampa, Fla. 33614

[21] Appl. No.: 353,982

[22] Filed: May 17, 1989

Related U.S. Application Data

[63] Continuation of Ser. No. 190,863, May 6, 1988, abandoned.

[51] Int. Cl.[5] ..... F25D 3/08

[52] U.S. Cl. ..... 248/146; 62/457.4; 248/310; 248/910

[58] Field of Search ..... 248/146, 346, 346.1, 248/910, 148, 312.1, 105, 311.2, 309.1, 457.4, 310; 220/85 H, 3.1, 903, 412, 215; 62/457.1, 457.3, 457.4

[56] References Cited

U.S. PATENT DOCUMENTS

| | | | |
|---|---|---|---|
| 2,727,645 | 12/1955 | Dore | 248/346.1 |
| 2,806,131 | 9/1957 | Palmer | 248/910 X |
| 3,028,702 | 4/1962 | St. Cyr | 248/310 X |
| 3,312,436 | 4/1967 | Beghetto, Jr. | 248/148 |
| 3,698,675 | 10/1972 | Leren et al. | 248/311 |
| 4,137,356 | 1/1979 | Shoemaker et al. | 248/346.1 X |
| 4,596,370 | 6/1986 | Adkins | 248/311.2 |
| 4,613,048 | 9/1986 | McGill | 297/194 |
| 4,629,153 | 12/1986 | Marcum | 248/311.2 X |
| 4,771,911 | 9/1988 | Morony et al. | 220/903 X |
| 4,788,916 | 12/1988 | Saxton | 248/910 X |

*Primary Examiner*—David L. Talbott
*Assistant Examiner*—Daniel Hulseberg
*Attorney, Agent, or Firm*—Joseph C. Mason; Ronald E. Smith

[57] ABSTRACT

A bag-like, flexible base member having flowable, granular particles therein is secured to the bottom of a rigid frame member having insulated interior walls to provide an insulated cup holder that may be placed on uneven surfaces without spilling a portable contained in a cup held by the novel holder. The frame may be coextensive with or extend above the insulation that lines the interior of the frame. In the embodiment where the frame extends beyond the insulation, a screw-threaded, rim-mounted member enhances the integrity of the structure. In another embodiment, the holder is surrounded by the bag-like base member.

11 Claims, 4 Drawing Sheets

INSULATED CUP HOLDER WITH FLEXIBLE BASE MEMBER CROSS REFERENCE TO RELATED APPLICATIONS

The present disclosure is a continuation of a co-pending application disclosure filed by the present inventor on May 6, 1988, entitled "Insulated Cup Holder with Flexible Base Member," Ser. No. 07/190,863.

TECHNICAL FIELD

This invention relates, generally, to insulated cup holders. More particularly, it relates to an insulated cup holder with a flexible base member and a structure that relates breakage.

BACKGROUND ART

Beverage cans are thin walled and it is well known that the temperature of a potable contained within a can changes quickly to ambient temperatures once such a can it taken from a controlled temperature storage location.

Moreover, cups with handles are also essentially uninsulated. Accordingly, inventors have devised quite a few different devices that serve to keep hot drinks hot and cold drinks cold.

A U.S. Design Patent to Bradley, U.S. Pat. No. D. 281,755, shows a holder for a drinking vessel that includes a flexible base member.

U.S. Pat. No. 2,803,366 to Forman shows a combination pot and holder that includes a shallow slot or cutaway portion that accommodates a lowermost portion of a handle for a coffee pot.

An insulated holder for a beverage can is shown in U.S. Pat. No. 3,013,691 to Prentice; further examples of insulated can or cup holders are shown in U.S. Pat. Nos. 3,302,427, 3,302,428, 4,383,422, 4,681,239 and 3,285,455.

One shortcoming of these earlier devices is their tendency to tip over easily. Another shortcoming is their inability to receive cups having handles. Still another limitation is that these earlier devices do not protect fragile beverage containers from damage; indeed, the insulated containers of the prior art are themselves easily breakable.

It is therefore apparent that there is a need for an insulated cup holder that is not easily tipped over and which may accommodate cups with handles. A need also exists for a cup holder that protects fragile beverage containers against breakage and which itself is substantially unbreakable.

The patents of the prior art, however, neither teach nor suggest how a cup holder not subject to the limitations of the prior art could be provided.

DISCLOSURE OF INVENTION

The long-standing but heretofore unfulfilled need for an improved insulated cup holder is now provided in the form of a device having a stable support means that resists tipping, a cup handle-receiving slot and a rigid frame member that guards fragile containers and which prevents the facile destruction of the device itself as well.

The stable support means includes a flexible bag means that is completely filled with particulate or granular matter of the type found in bean bag chairs or of other types, such as stone or other matter.

In a first embodiment, the flexible bag means is fixedly secured about its uppermost periphery to the bottom of a rigid, cylindrical in configuration frame member that is lined with a layer of insulation. The frame member has an imperforate bottom wall which cooperates with the flexible bag member to enclose the granular matter. A cup-engaging, rim-mounted cup supporting means holds a cup inserted into the open upper end of the device in spaced relation to the insulating material so that a small, insulating air space separates the cup from said insulating material.

In a second embodiment, a flexible bag means extends to the upper periphery of the container and the bag is completely filled with granular material. Thus, the granular bag filler surrounds the insulated frame member, thereby providing a double insulation means.

Where a fragile beverage container such as a styrofoam cup is inserted into the holder, any downwardly directed forces will be resisted by the rigid frame member, thereby extending the usable lifetime of the cup and that of the inventive device as well.

Where a cup of the type having a handle is desired to be insulated, the handle thereof is aligned with a slot formed in the device and the cup is slidably inserted thereinto.

The particles contained in the flexible bag means which depends to the frame member are free flowing; accordingly, when the device is placed upon an uneven surface, the flexible bottom wall of the bag member conforms to the contour of such surface. The uneven position of the bag bottom wall is not communicated to the rigid frame member due to the flowability of the particulate matter, i.e., the top layer of the particles may be level while the underlying mass of particles may be uneven. The flat bottom wall of the rigid frame member is simply placed in a level disposition by the user of the invention to conform the upper regions of particles to a level configuration, without regard to the uneven configuration of the lower regions of particles.

Another embodiment of the invention provides a frame member having an upwardly extending, non-insulated portion that enhances the protection of the insulation lining the balance of the frame member. The extension portion is externally threaded to screw-threadedly receive an internally threaded cup supporting means.

The primary object of this invention is therefore seen to include the provision of a tipping-resistant insulated container that may be placed on non-level surfaces.

Other objects of this invention relate to the provision of a handle-accommodating insulated container that has a rigid frame means which protects fragile containers when they are positioned therein and which preserves the structural integrity of the device as well.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

Similar reference numerals refer to similar parts throughout the several views of the drawings.

BEST MODES FOR CARRYING OUT THE INVENTION

Figure 1:
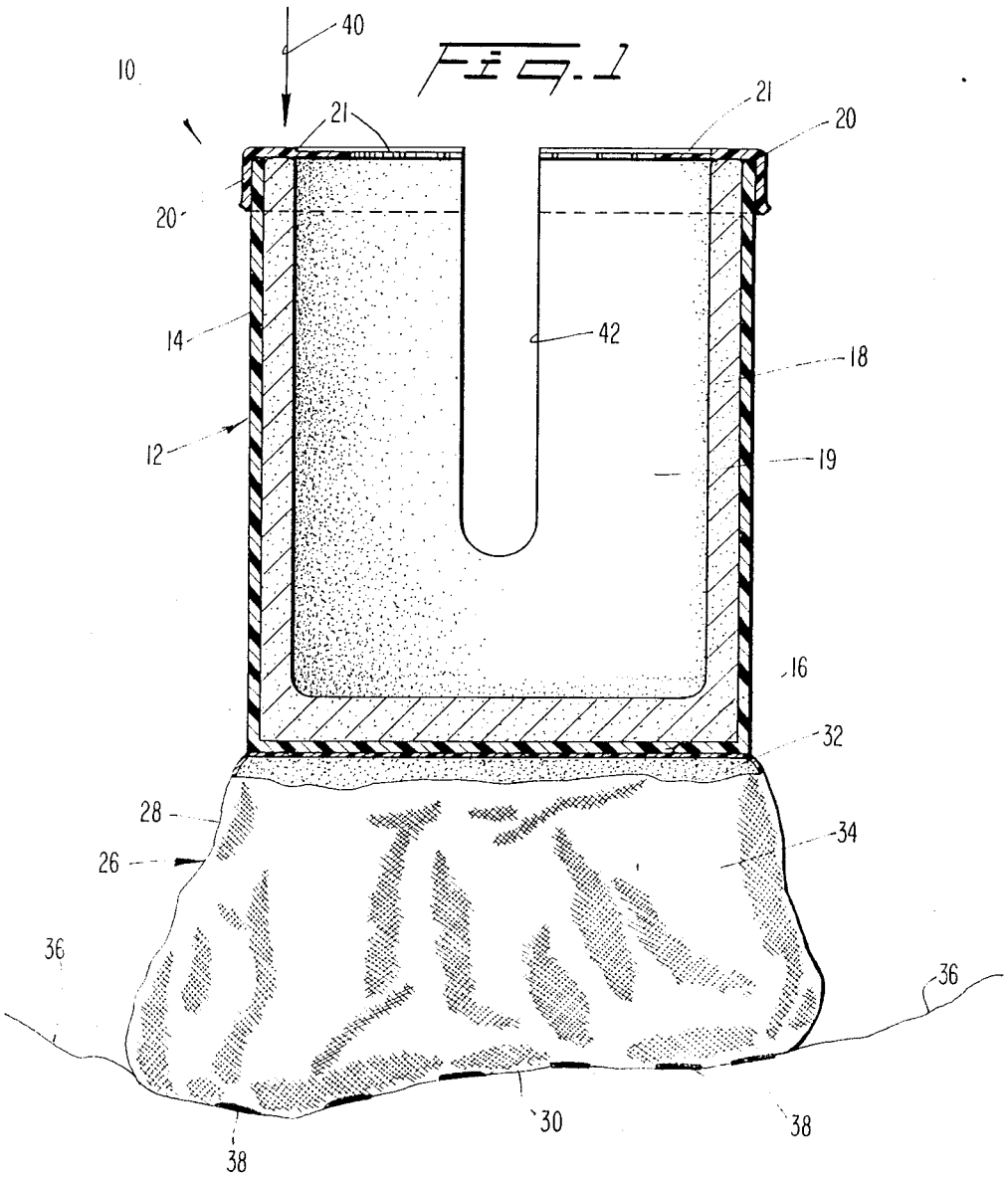
FIG. 1 a side elevational, partially in section view of the novel insulated cup holder of this invention.

Referring now to FIG. 1, it will there be seen that an illustrative embodiment of the present invention is designated by the reference numeral 10 as a whole. Device 10 includes a rigid, cylindrical in configuration frame member 12 that includes cylindrical sidewalls 14 and a flat, imperforate bottom wall 16.

The interior surface of sidewall 14 is lined with a layer of suitable insulating material 18 such as styrofoam. Material 18 is permanently bonded to frame 12 by a suitable adhesive, not shown. Reference numeral 19 denotes the cup-receiving cavity of this invention.

Figure 2:
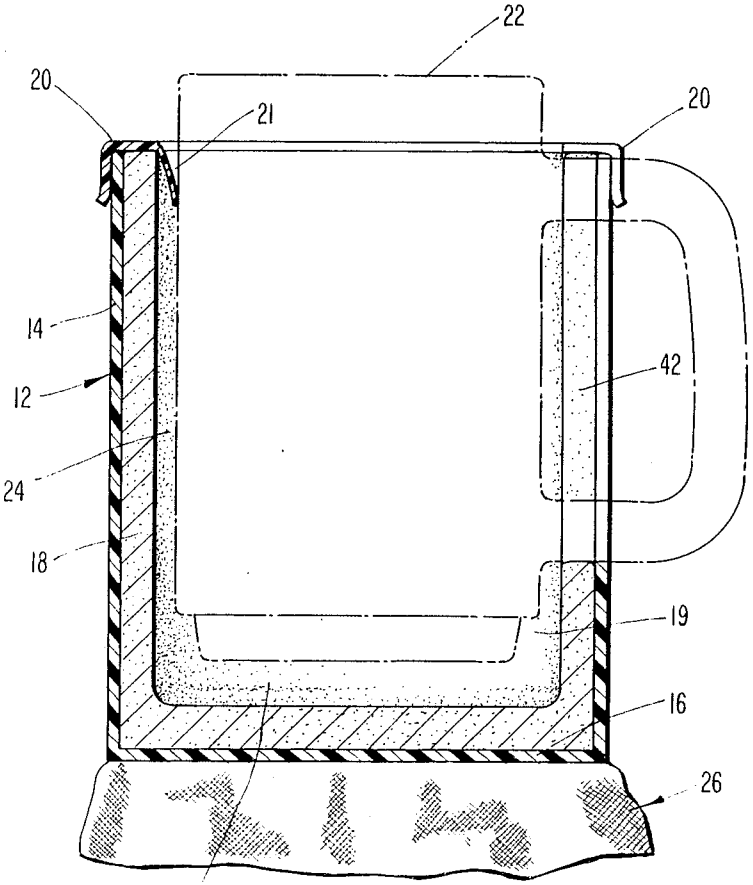
FIG. 2 is a view similar to FIG. 1 but showing a cup with a handle positioned within the holder.
Figure 3:
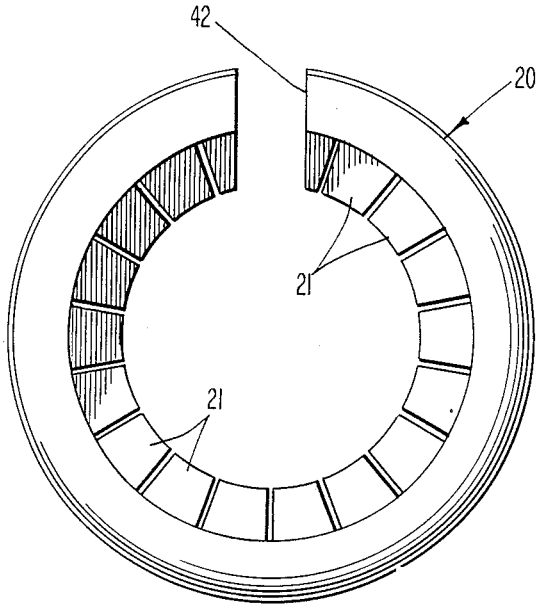
FIG. 3 is a top plan view of the device.

A cup-engaging and cup-centering member 20 is press fit to the upper rim of the device 10 as shown. Member 20 includes plural radially-inwardly directed flexible cup-supporting means, collectively designated 21, (FIG. 3) which transiently displace downwardly when a cup is slidably inserted into cavity 19 as shown in FIG. 2.

As shown in FIGS. 2, 6, 7 and 9, cup-supporting means 21 centers a slidably inserted cup member 22 with respect to cavity 19 so that an insulating area of dead air space 24 surrounds cup 22. In this manner, device 10 provides two types of insulation, i.e., that of insulating material 18 and that of airspace 24.

Frame member 12 is supported by a flexible support means, designated 26 as a whole. Support means or base member 26 includes a bag means fixedly secured, by a suitable means, to frame member 12 as shown; it is formed of a suitable flexible material such as leather, imitation leather, or the like. Base member 26 includes flexible sidewalls 28 and flexible bottom wall 30, all of said walls 28 and 30 being imperforate. The upper annular periphery of the bag means may be secured to the lowermost annular periphery of frame member 12 or the bag means may be attached as shown so that the granular material 32 is enclosed within the cavity 34 defined by the bag means 26.

Preferably, bag means 26 is completely filled with granular material 32 as shown in FIG. 1.

Accordingly, bottom wall 16 of frame 12 rests atop a level layer of particulate material 32 when the invention is in use.

Of particular interest is the uneven surface 36 upon which the device 10 is shown resting in FIG. 1. Flexible bottom wall 30 of bag means 26 conforms to the contour of the surface 36 as shown. Due to the presence of the granular material 32, this uneven contour is not transmitted to bottom wall 16 of rigid frame member 12. In this manner, device 10 has utility even when placed upon the most irregular of surfaces. Moreover, the weight of material 32 provides a high degree of stability to the device.

If device 10 is struck with a lateral blow, frame member 12 will shift position in response thereto, but it will not tip over, due to the weight and fluidity of the granular material.

Figure 4:
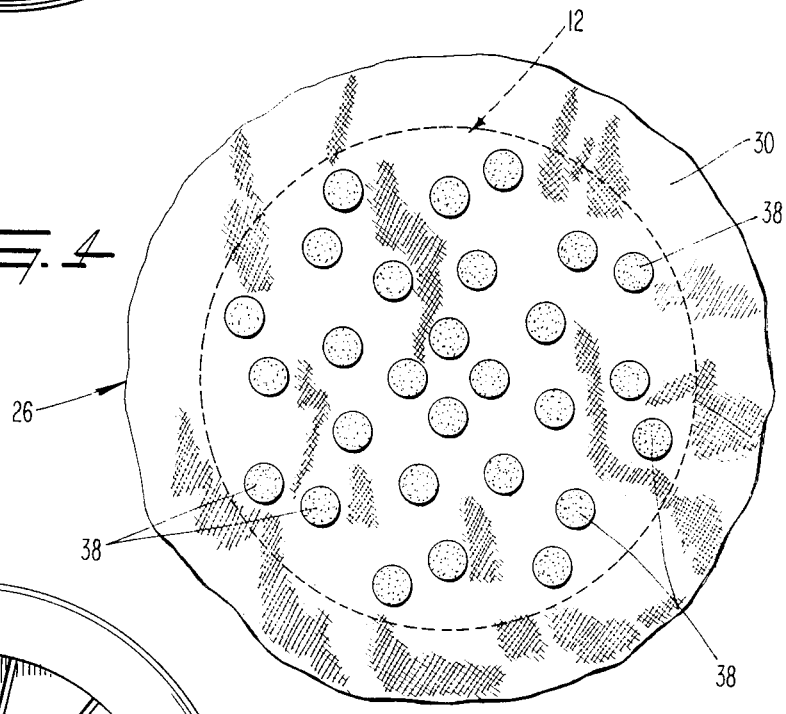
FIG. 4 is a bottom plan view thereof.
Figure 5:
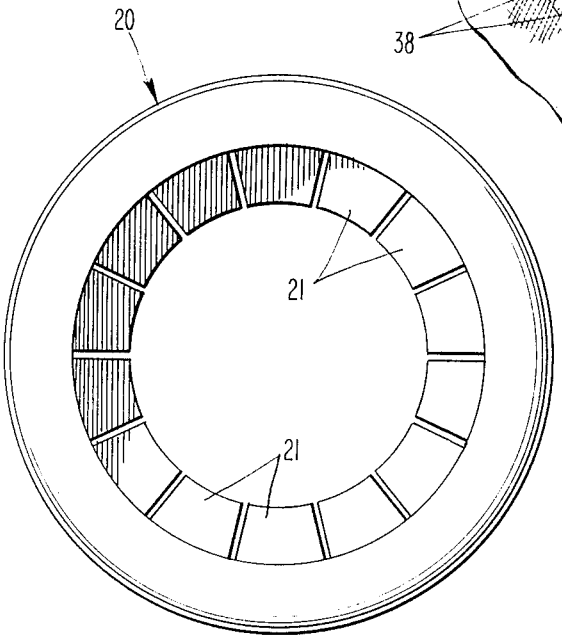
FIG. 5 is a top plan view of a slotless embodiment of the device.

To further enhance the non-slip characteristic of the device, a plurality of non-skid members 38 are fixedly secured to the exterior surface of bag bottom wall 30 a shown in FIG. 4.

If device 10 is stepped on or otherwise subjected to downwardly directed forces impinging thereagainst as denoted by the single-headed directional arrow 40 in FIG. 1, the soft styrofoam 18 will be guarded by the rigid frame member 12. Said frame 12 may be formed of any suitable rigid material, but it is preferably formed of a lightweight, high impact plastic.

Thus, frame 12 is seen to be an important feature of this invention.

The slot means 42 shown in the FIG. 1 embodiment is another important feature; it slidingly receives the handle portion of a cup of the type having a handle as shown in FIG. 2.

Figure 7:
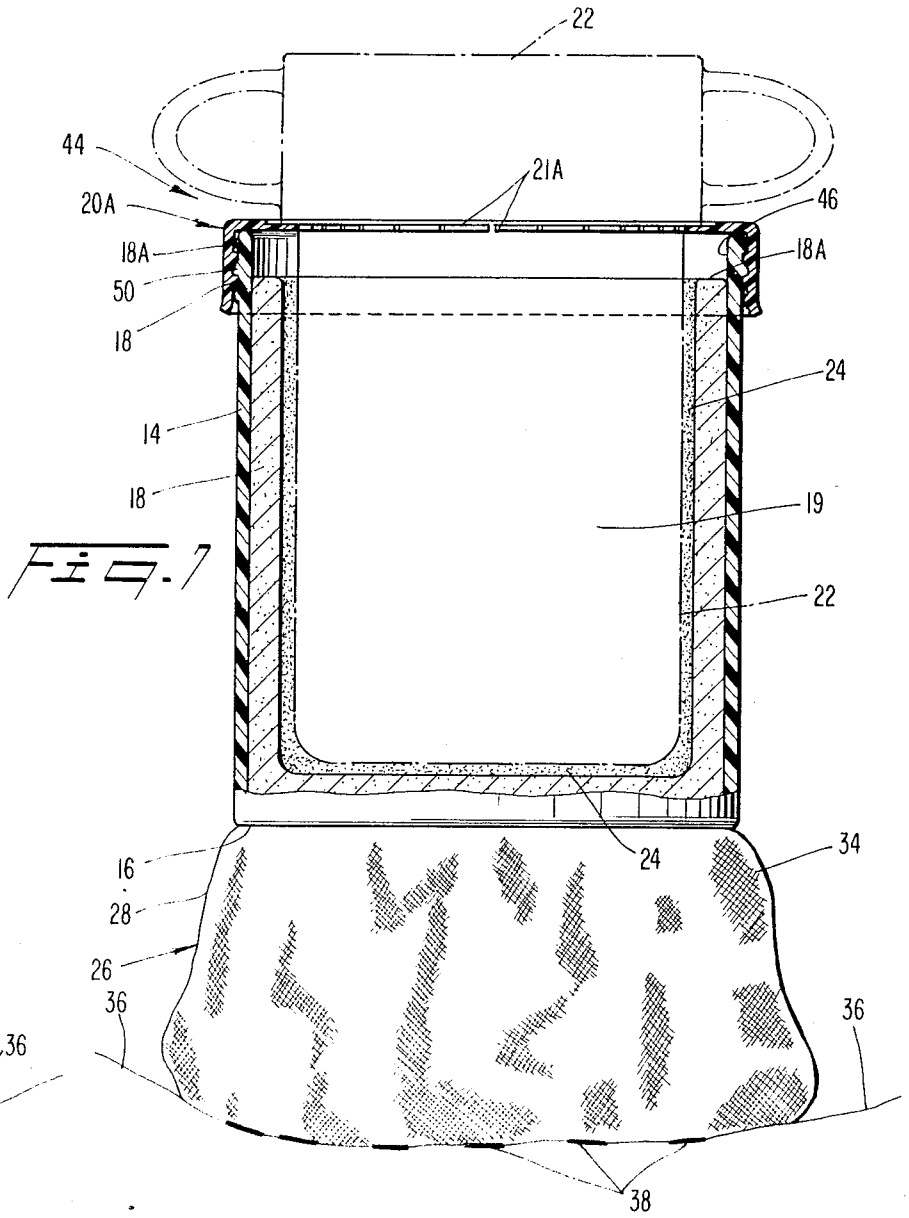
FIG. 7 is a side elevational, partially in section view of the screw-threaded embodiment of the invention.
Figure 6:
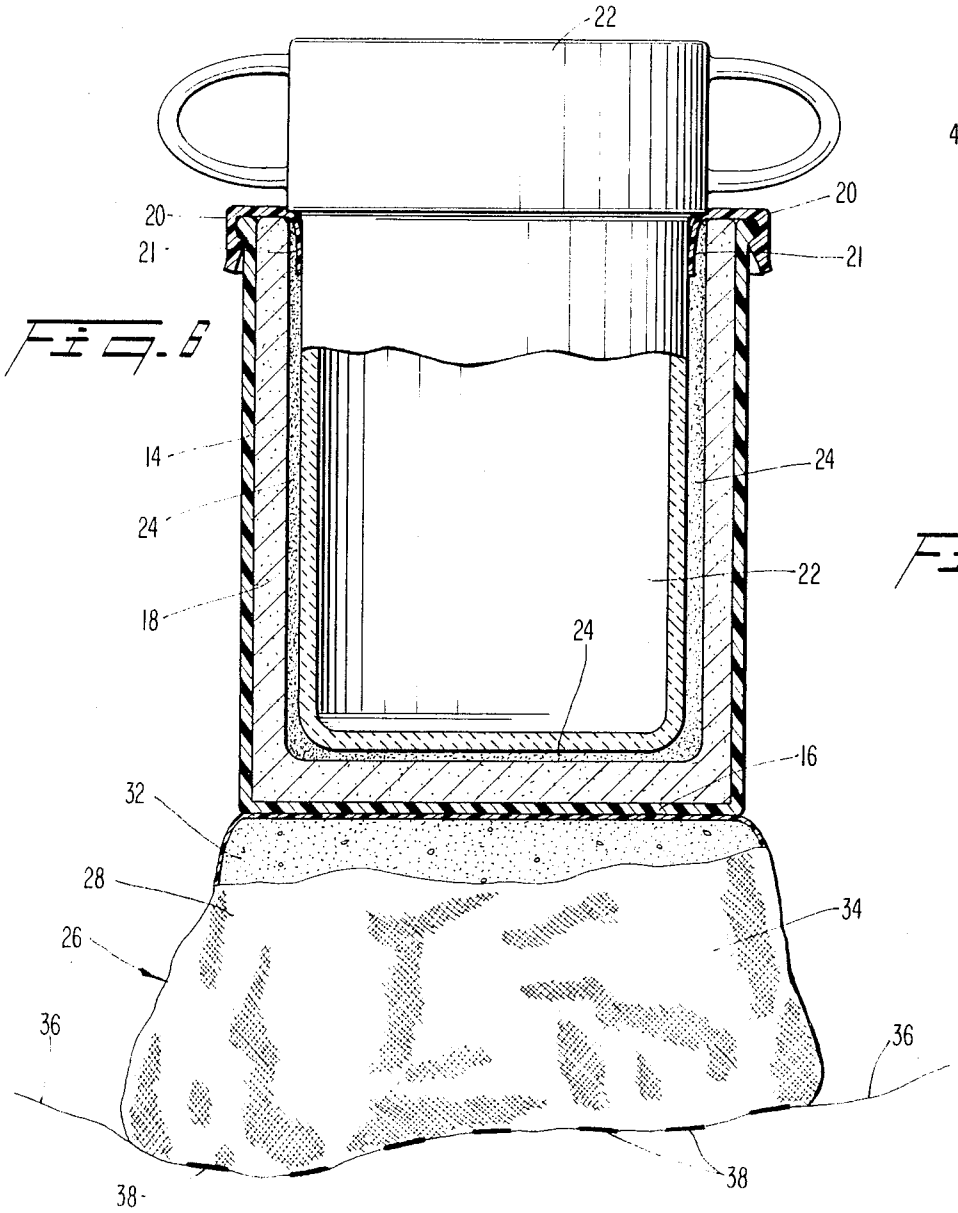
FIG. 6 is a side elevational, partially in section view of the device showing a double-handled cup therein.

Referring now to FIG. 7, it will there be seen that still another embodiment of the invention is denoted by the reference numeral 44 as a whole. It differs from the embodiments described above in three important respects. As shown, rigid frame member 12 and the insulating material 18 are not co-extensive in this embodiment in that the cylindrical sidewalls 14 of frame 12 extend upwardly beyond the uppermost periphery of said insulation 18; specifically, reference numeral 46 denotes that portion of sidewalls 14 that extend beyond the uppermost periphery 18A of said insulating material 18.

Secondly, cup supporting or cup-centering member 20 is different in the embodiment of FIG. 7, and is denoted 21*a*. Specifically, cup supporting member 20A is internally threaded as at 48 and portion 46 of sidewall 14 is externally threaded as at 50 to screw-threadedly engage the same.

In this manner, the structural integrity of apparatus 44 is enhanced. It should be observed that insulation 18 could extend all the way to the top of frame portion 46, but it is believed that the styrofoam 18 is better protected by extending frame 12 sidewalls 14 as shown.

The third of the above-mentioned differences is the unbonded relationship between the insulating material 18 and the sidewalls of frame 12 in this embodiment. Not bonding styrofoam 18 to the interior sidewalls of frame 12 permits removal and replacement of such insulation 18 if it becomes damaged. Moreover, frame 12 can be used as a cup means should styrofoam 18 break and there be no replacement readily available therefor.

Figure 8:
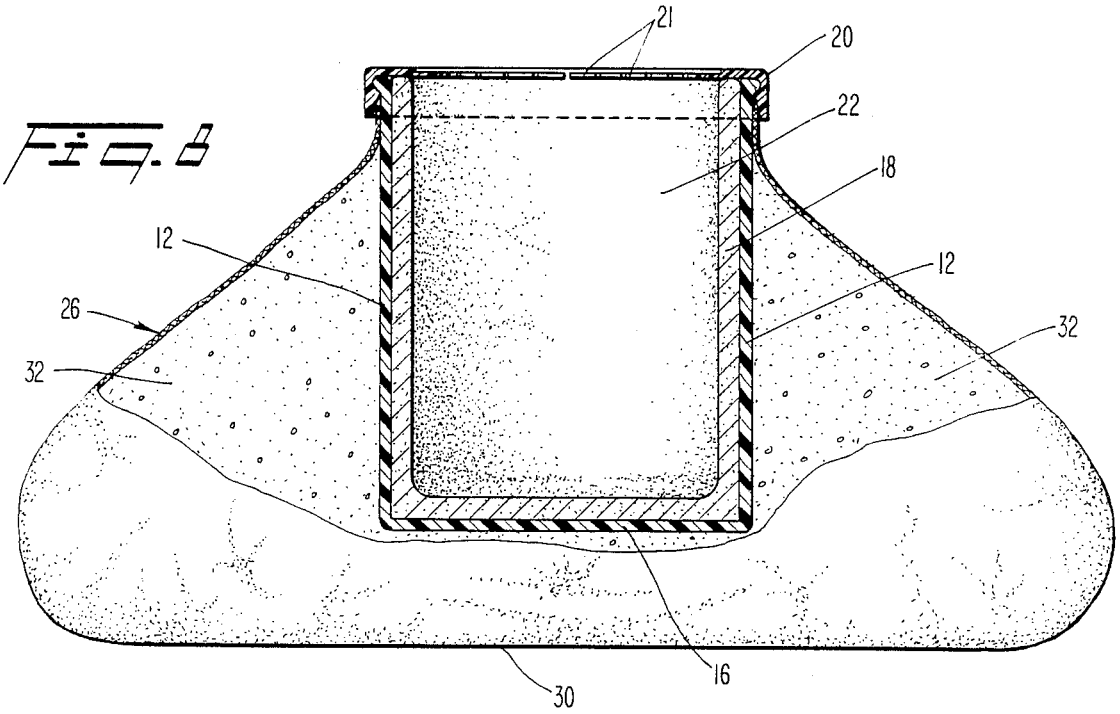
FIG. 8 is a side elevational, sectional view of another embodiment the invention.
Figure 9:
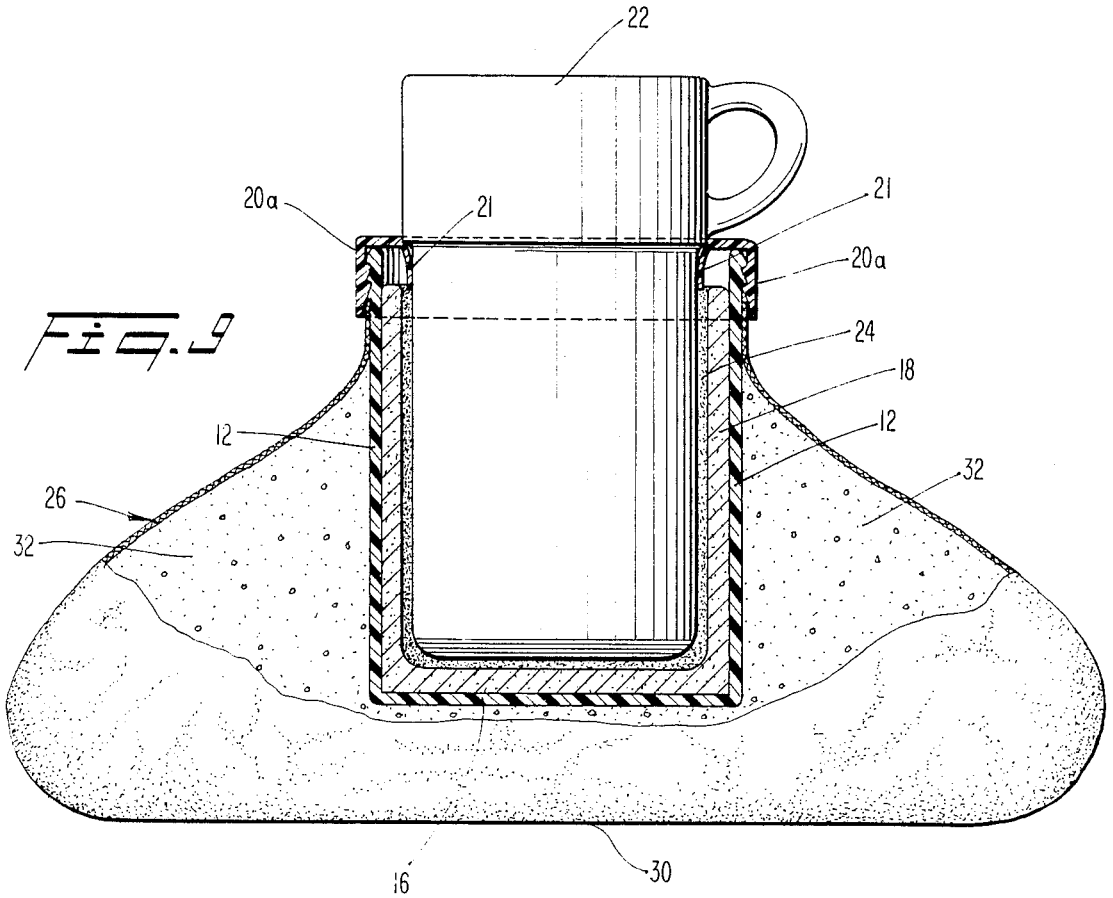
FIG. 9 is a side elevation, sectional view of still another embodiment of the invention.

FIGS. 8 and 9 show embodiments where bag means 26 surrounds frame member 12 and is completely filled with granular material 32 as shown. This structure further increases the insulating properties of the container. In fact, container holders having both insulated material 18 and 32 were heretofore unknown. The insulation 18 of the earlier-described embodiments could also be provided in non-bonded form; thus, this invention is not restricted to bonded or unbonded insulating material.

The unique, flowable, weighted base member of this invention, together with the crush-resistant frame member and the other features of this invention, provide ample evidence that this invention has advanced the art of insulated cup holders.

INDUSTRIAL APPLICABILITY

This invention will be used primarily by consumers. Its rugged construction and durability make it suitable for use in industrial as well as household environments.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An insulated cup holder, comprising:

a rigid, cylindrical frame member having an uppermost rim;

said frame member having an imperforate bottom wall and sidewalls projecting upwardly therefrom, defining a first cavity means therebetween;

a layer of breakable insulating material disposed in overlying relation to interior surfaces of said frame member bottom wall and to at least a lower portion of said side-walls;

an upper part of said sidewalls extending upwardly of an uppermost end of said insulating material;

a base member for supporting said frame member;

said base member including a flexible bag means having an annular mouth;

said flexible bag means defining a second cavity means;

a flowable, unbreakable granular material completely filling said second cavity means;

said bag means and said frame member being fixedly secured to one another, said annular mouth of said bag means being secured to said frame member sidewalls, slightly downwardly of the uppermost rim of said frame member so that said frame member is substantially surrounded by said granular material, thereby enhancing the insulation of said frame member;

a cup-engaging and centering means releasably secured to the uppermost rim of said frame member;

said bag means having a flexible bottom wall capable of conforming to the contour of an uneven support surface; and a plurality of non-skid pad members being secured to an exterior surface of said bag means bottom wall at randomly spaced positions thereupon.

2. The holder of claim 1, wherein said frame member bottom wall is a flat, circular plate member and wherein said frame member sidewalls are cylindrical in configuration.

3. The holder of claim 2, wherein said cup-engaging and centering means includes an annular, flexible rim-engaging means and a plurality of radially-inwardly extending cup-engaging members that transiently deform in the direction of cup travel when a cup member is slidably inserted into said first cavity means.

4. The holder of claim 3, wherein external threads are formed on said upper part of said sidewalls that project upwardly relative to said uppermost end of said insulating material.

5. The holder of claim 4, wherein internal threads are formed on said cup-engaging and centering means for screwthreaded engagement of said cup-engaging and centering means and said frame member to further enhance the protection provided to said insulating material and to enhance the structural integrity of the holder.

6. An insulated cup holder, comprising:

a cylindrical frame member having a flat, imperforate bottom wall and an uppermost rim;

said frame member formed of a rigid material and being substantially unbreakable by downwardly directed forces impinging thereagainst;

a layer of breakable insulating material disposed in overlying relation to interior surfaces of said frame member;

said insulating material being substantially protected against breakage by said frame member;

a bag member having an annular mouth being fixedly secured to said frame member slightly downward of said uppermost rim;

said bag member forming a cavity means;

a flowable, unbreakable granular material completely filling said cavity means;

said frame member being substantially surrounded by said granular material, slightly downward of said frame member;

said bag member having a bottom wall sufficiently flexible to conform to a contour of an uneven support surface;

said frame member extending upwardly beyond an uppermost periphery of said breakable insulating material to provide an enhanced protection means against breakage of said breakable insulating material and a plurality of non-skid pad members fixedly secured to an exterior surface of said bottom wall at randomly spaced positions thereupon.

7. The holder of claim 6, wherein said insulating material is soft and frangible and is protected against breakage by said frame member.

8. The holder of claim 7, further comprising a cup-engaging and centering means releasably secured to a rim of said holder.

9. The holder of claim 8, wherein said cup-engaging and centering means includes a flexible, annular-in-configuration rim-engaging member having plural, flexible radially-inwardly extending cup-engaging members formed thereon.

10. The holder of claim 9, wherein external threads are formed on that portion of said sidewalls that project upwardly relative to said uppermost periphery of said insulating material, and wherein internal threads are formed on said cup-engaging and centering means for screw-threaded engagement of said cup-engaging and centering means and said frame member to further enhance the protection provided to said insulating material and to enhance the structural integrity of the holder.

11. An insulated cup holder including a rigid frame member that is substantially non-breakable, said frame member having a bag member disposed in surrounding relation thereto, said bag member being completely filled with a particulate, flowable material, said bag member having an annular mouth and said mouth being fixedly secured to an uppermost periphery of said frame member, so that said holder is substantially surrounded by said completely-filled bag member to enhance the insulation of said holder, said holder further comprising a breakable insulating material overlying at least a portion of interior sidewalls of said frame member and a cup-receiving cavity means being surrounded by said insulating material, said frame member sidewalls extending upwardly beyond an uppermost periphery of said breakable insulating material to provide an enhanced protection means against breakage of said breakable insulating material, wherein external threads are formed on a part of said sidewalls that project upwardly relative to said uppermost periphery of said breakable insulating material, wherein internal threads are formed on said cup-engaging and centering means for screw-threaded engagement of said cup-engaging and centering means and said frame member to further enhance the protection provided to said breakable insulating material and to enhance the structural integrity of the holder, and further comprising a plurality of randomly arrayed non-skid pad members fixedly secured to a bottom side of said bag member.

* * * * *